United States Patent [19]

Whitlock

[11] 4,123,184

[45] Oct. 31, 1978

[54] UNDERGROUND FIRE HYDRANT FRAME AND COVER

[76] Inventor: Leslie A. Whitlock, 510 Scenic Dr., Modesto, Calif. 95350

[21] Appl. No.: 868,870

[22] Filed: Jan. 12, 1978

[51] Int. Cl.[2] ..... E02D 29/14

[52] U.S. Cl. ..... 404/25; 52/21

[58] Field of Search ..... 404/25, 26, 71, 77, 404/79; 52/19, 20, 21; 210/164, 163

[56] References Cited

U.S. PATENT DOCUMENTS

| | | | |
|---|---|---|---|
| 166,574 | 8/1975 | Willbur | 404/25 |
| 175,725 | 4/1976 | Mecklenberg | 404/25 |
| 1,349,136 | 8/1920 | Lillard | 404/79 X |
| 1,987,502 | 1/1935 | Born | 404/25 |
| 2,094,523 | 9/1937 | Bugbee | 404/25 |
| 3,521,537 | 7/1970 | Forni | 404/25 |
| 3,621,623 | 11/1971 | Downes | 404/25 |
| 3,920,347 | 11/1975 | Sauriol | 404/25 |
| 3,938,545 | 2/1976 | Nagy | 52/21 X |

*Primary Examiner*—Nile C. Byers, Jr.
*Attorney, Agent, or Firm*—John N. Randolph

[57] ABSTRACT

A frame and cover for an underground fire hydrant, especially adapted for use in locating a fire hydrant in a highway, preferably at an intersection, and by means of which the fire hydrant is rendered readily accessible for use.

4 Claims, 5 Drawing Figures

FIG. 1
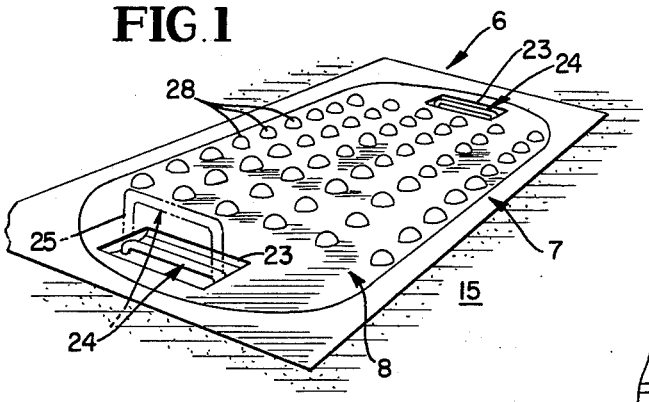
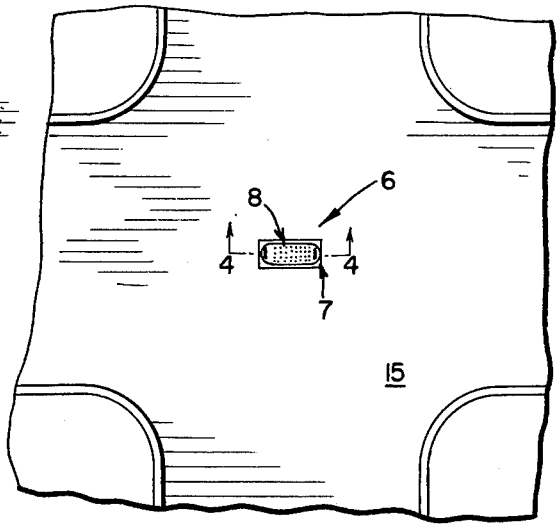
FIG. 3
FIG. 2
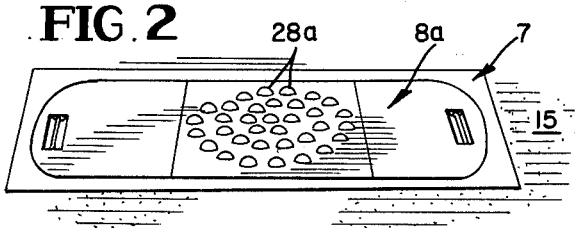
FIG. 4
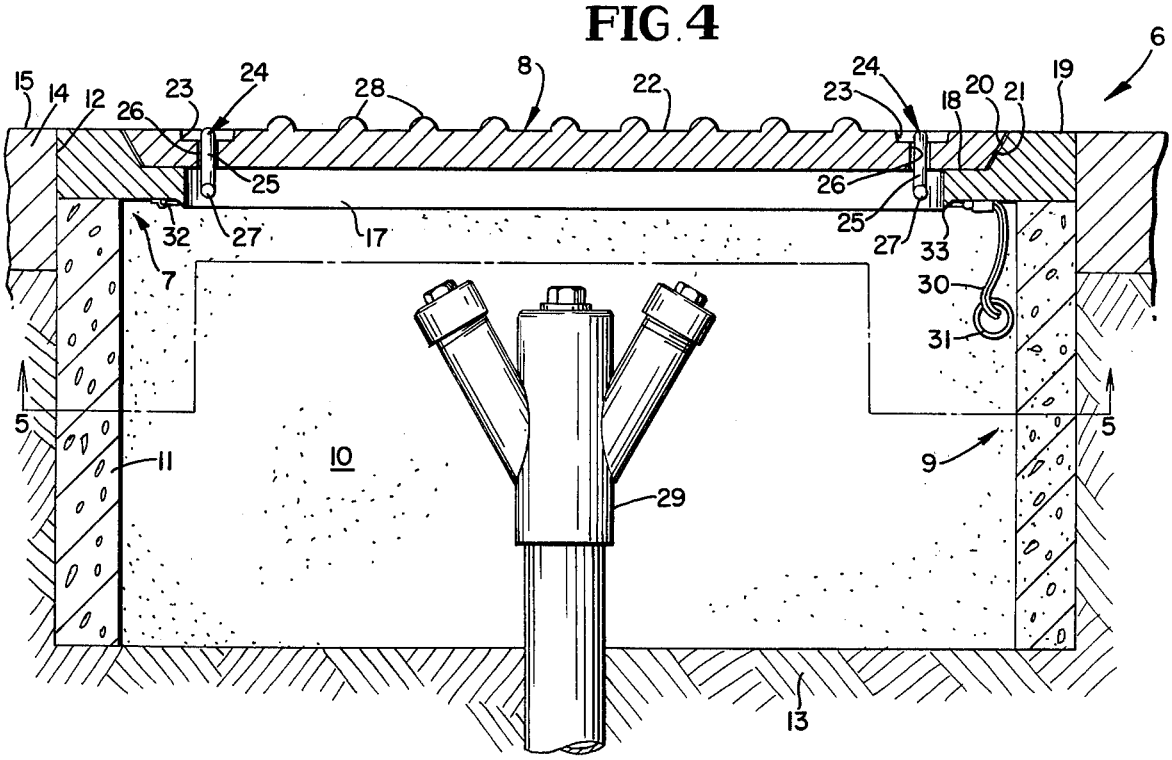
FIG. 5
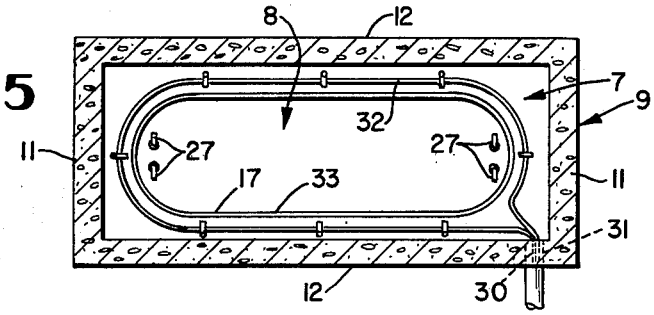

UNDERGROUND FIRE HYDRANT FRAME AND COVER

SUMMARY

Among the primary objects of the invention are to provide a fire hydrant which cannot be damaged by being struck by vehicles; which can be located in the center of a street where burning or falling structures cannot hamper its use; which will afford more curb parking space; which can be utilized by two pumpers where sufficient water supply is available, and which can be more readily kept available in freezing weather.

Another object of the invention is to provide a fire hydrant cover and frame which will not interfere with the movement of vehicular traffic over the cover and which can readily be located at night.

Various other objects and advantages of the invention will hereinafter become more fully apparent from the following description of the drawing, illustrating presently preferred embodiments thereof, and wherein:

BRIEF DESCRIPTION OF THE DRAWING

FIG. 1 is a perspective view from above of the frame and cover located in a highway;

FIG. 2 is a similar view showing a slightly modified embodiment of the cover,

FIG. 3 is a top plan view on a reduced scale showing the frame and cover located in the center of a highway intersection;

FIG. 4 is an enlarged vertical sectional view taken substantially along a plane as indicated by the line 4—4 of FIG. 3, and showing the frame and cover in place above a conventional fire hydrant, and FIG. 5 is a sectional view taken substantially along the line 5—5 of FIG. 4.

DESCRIPTION OF THE PREFERRED EMBODIMENT

Referring more specifically to the drawing and with reference to FIGS. 1, 3, 4 and 5, the fire hydrant frame and cover in its entirety and constituting the invention is designated generally 6 and comprises a frame 7 and a cover 8. A rectangular concrete or masonry supporting structure 9, composed of side walls 10 and end walls 11, lines a pit 12 in the earth 13 and rests on the bottom of the pit, as seen in FIG. 4. Pit 12 opens upwardly through a portion of a highway 14 in which the upper part of the supporting structure 9 is embedded below the highway surface 15. The upper part of the opening 12 accommodates the frame 7 which is rectangular and rests on the top portion of the supporting structure 9. Said frame 7 fits snugly in the top portion of the opening 12 and is of a thickness such that its top surface is flush with the top surface 15 of the highway.

The frame 7 has a large oval shaped opening 17 and is provided with a ledge 18 surrounding the opening 17 and is disposed below the level of the top surface 19 of the frame 7. Frame 7 has a downwardly and inwardly inclined or bevelled continuous surface 20 extending from its top surface 19 to the ledge 18.

The cover 8 is oval shaped and has a bevelled surrounding surface 21 of a proper size and shape to conformably fit the bevelled surface 20, when a marginal portion of the underside of the cover 8 is resting on the ledge 18. The cover 8 is of a thickness such that its upper surface 22 is disposed substantially flush with the upper surface 19 when the cover is resting on the ledge 18.

Cover 8 has recesses 23 near the ends thereof to accommodate conventional inverted U-shaped handles 24 the depending legs 25 of which extend slidably through openings 26 which communicate with the recesses 23 and with the underside of the cover 22. The lower ends of the legs 25 are turned outwardly, as seen at 27, to provide abutments to engage the underside of the cover 22 to limit the extent that the handles 24 can be raised without lifting the cover 22. The cover or lid 8 has a plurality of hemispherical knobs 28 which protrude from its upper surface 22. The knobs 28 are spaced from one another and form a rectangle, as seen in FIG. 1. The knobs 28 are coated with a material which will reflect the head-light rays of vehicles to enable the cover 8 to be readily located at night.

A conventional fire hydrant 29 extends upwardly into the pit 12 and is located within the structure 9, beneath the frame and cover 6. The hydrant 29 has two outlets enabling it to be utilized simultaneously by two pumpers.

Electrical conductors 30 lead into the enclosure 9 through an opening 31 in one wall thereof and connect with an electric heating element 32 which is secured to the underside of the frame 7, around the opening 17, for heating said frame and cover 8 in subfreezing weather, to keep the frame and cover free of ice and snow and accessible for use under any weather condition. The underside of the frame 7 has a depending lip 33 from which moisture can drain without coming into contact with the heating element 32. A heat lamp, not shown, can be substituted for the heating element 32.

FIG. 2 shows a slightly modified form of the lid or cover, designated 8*a*, and wherein the knobs 28*a* are arranged in the form of a circle. Knobs 28*a* otherwise correspond to the knobs 28 and the lid or cover 8*a* otherwise corresponds with the lid or cover 8.

Various other modifications and changes are contemplated and may be resorted to without departing from the function or scope of the invention.

I claim as my invention

1. A closure for the open top of a pit containing an underground fire hydrant comprising a frame adapted to rest on and be supported by a part of the pit with the upper surface of said frame flush with a surrounding highway surface, said frame having a large opening and a recessed upper surface surrounding said opening, and a cover having a marginal portion shaped to fit in said recessed portion of the frame for closing the frame opening, said cover being of a thickness such that its upper surface is disposed substantially flush with the upper surface of the frame when the cover is supported by the frame, an electric heating element secured to the underside of the frame around the opening thereof for heating the frame and cover to prevent the accummulation of ice and snow on the upper surface thereof, and said frame having a depending lip surrounding the opening and disposed between said heating element and the opening to protect the heating element from moisture draining through the opening.

2. A closure as in claim 1, said cover having a plurality of rounded knobs protruding from its upper surface and provided with a light reflective coating to facilitate locating the cover in the darkness.

3. A closure as in claim 2, said knobs being disposed in spaced apart relationship to one another and in the form of a rectangle.

4. A closure as in claim 2, said knobs being disposed in spaced apart relationship to one another and in the form of a circle.

* * * * *